US006351276B1

(12) United States Patent
Yamaguchi

(10) Patent No.: US 6,351,276 B1
(45) Date of Patent: Feb. 26, 2002

(54) THERMAL RECORDING APPARATUS

(75) Inventor: Akira Yamaguchi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/315,941

(22) Filed: May 21, 1999

(30) Foreign Application Priority Data

May 21, 1998 (JP) ..... 10-139821

(51) Int. Cl.[7] ..... B41J 2/36
(52) U.S. Cl. ..... 347/188
(58) Field of Search ..... 347/189, 188, 347/211, 203; 400/120.09, 120.11; 358/458

(56) References Cited

U.S. PATENT DOCUMENTS 5,635,974 A * 6/1997 Yasutomi et al. ..... 347/203
5,661,514 A * 8/1997 Lukis et al. ..... 347/211
5,809,879 A * 9/1998 Yokoyama et al. ..... 347/189
6,034,707 A * 3/2000 Agano ..... 347/211

* cited by examiner

*Primary Examiner*—N. Le
*Assistant Examiner*—K. Feggins
(74) *Attorney, Agent, or Firm*—Sughrue Mion, PLLC

(57) ABSTRACT

The thermal recording apparatus is capable of recording an image of high quality having sufficient sharpness without performing a sharpness correction processing in which a scanning line structure is visually unrecognizable. The apparatus records the image using a thermal head of which a recording density is 400 dpi or more by dividing heat recording per pixel in the sub-direction to between 2 points and 4 points.

12 Claims, 12 Drawing Sheets

THERMAL RECORDING APPARATUS

BACKGROUND OF THE INVENTION

This invention relates to a thermal recording apparatus which performs a thermal recording on a thermal recording material using a thermal head.

The thermal recording employing thermal recording materials (hereinafter thermal materials) comprising a thermal recording layer on a side of a substrate such as paper or film has been commonly utilized to record an image produced in diagnosis by ultrasonic scanning.

The thermal recording eliminates the need for wet development processing and offers several advantages including convenience in handling. Hence in recent years, the use of the thermal recording system is not limited to small-scale image recording in such as diagnosis by ultrasonic scanning and an extension to those areas of medical diagnosis such as MRI and X-ray photography where large and high-quality images are required is under review.

The thermal recording apparatus uses a thermal head having a glaze in which heating elements corresponding to the number of pixels of one line are arranged in a main direction and, with the glaze slightly pressed against the thermal recording layer of the thermal material, the two members are moved relative to each other in a sub-direction approximately perpendicular to the main direction, and the respective heating elements in the glaze are heated with provision of recording energy in accordance with an image data of the image to be recorded to heat the thermal recording layer of the thermal material imagewise, thereby accomplishing image reproduction.

The thermal recording apparatus receives the image data from image supply sources such as a CT diagnosis apparatus, an MRI diagnosis apparatus and the like, subjects the received image data to image processing such as sharpness correction and the like for increasing sharpness by emphasizing an outline of the image so as to obtain a clear and impressive image and heats respective heating elements by driving the thermal head in accordance with the image data which has been subjected to image processing to record a thermal image corresponding to the image data inputted from the image data supply source.

The thermal recording apparatus has a problem that, when the image is recorded on the thermal material by the thermal head, the recorded image becomes blurred due to heat diffusion to have basically lower resolution compared with the image recorded on a light sensitive material by such as a laser beam.

To solve this problem compensating a blurred image due to heat, it has been necessary to use a peaking filter or the like for compensating the blur of the image caused by the heat thereby increasing the grade of emphasis on the sharpness of the image to be recorded so that the above-described sharpness correction processing is performed.

However, in an ordinary thermal recording apparatus, necessity of increasing the sharpness by performing the sharpness correction processing as described above caused emphasis of a noise component at the same time or, as shown in FIG. 14, when such as a letter 'H' was recorded, the outline of the letter 'H' was in some cases exaggerated to produce a false outline (artifact), depending on an algorithm for sharpness correction processing.

Moreover, when the thermal head with a recording density of about 300 dpi (dots/inch) was used, a scanning line structure which corresponded to coarse-graininess of dots of respective recording pixels in the thermal head became visually recognizable, thereby deteriorating the quality of the recorded image. This decrease of the quality of the recorded image became an obstacle for image observation in an application which required for an intermediate tone with high precision and high quality such as medical diagnosis as described above to bring about a serious problem leading to a diagnosis error.

SUMMARY OF THE INVENTION

The present invention has been accomplished under these circumstances and has an object to provide a thermal recording apparatus which is capable of recording a high-quality image that has sufficient sharpness without performing sharpness correction processing and allows a scanning line structure to be visually unrecognizable.

In order to achieve the above object, the invention provides a thermal recording apparatus for two-dimentionally recording the image on a thermal material which moves relatively in a sub-direction approximately perpendicular to a main direction by a thermal head comprising a specified number of heating elements arranged in said main direction, wherein a recording density of said thermal head is 400 dpi or more, and wherein said image is recorded by dividing heat recording points per pixel in said sub-direction into between 2 and 4.

It is preferable that heating duty of a control signal which controls an ON-OFF of said heating element is set between 25% and 50%.

Preferably, a heater width of said heating element in the main direction is between 20 $\mu$m and 50 $\mu$m, and wherein a heater length of said heating element in the sub-direction is between 30 $\mu$m and 60 $\mu$m.

Preferably, a coating thickness of a protective layer for coating a surface of said heating element is between 4 $\mu$m and 8 $\mu$m.

It is further preferable that the recording density of said thermal head is 508 dpi.

DETAILED DESCRIPTION OF THE INVENTION

The thermal recording apparatus of the invention will now be described in detail with reference to the preferred embodiments shown in the accompanying drawings.

Figure 1:
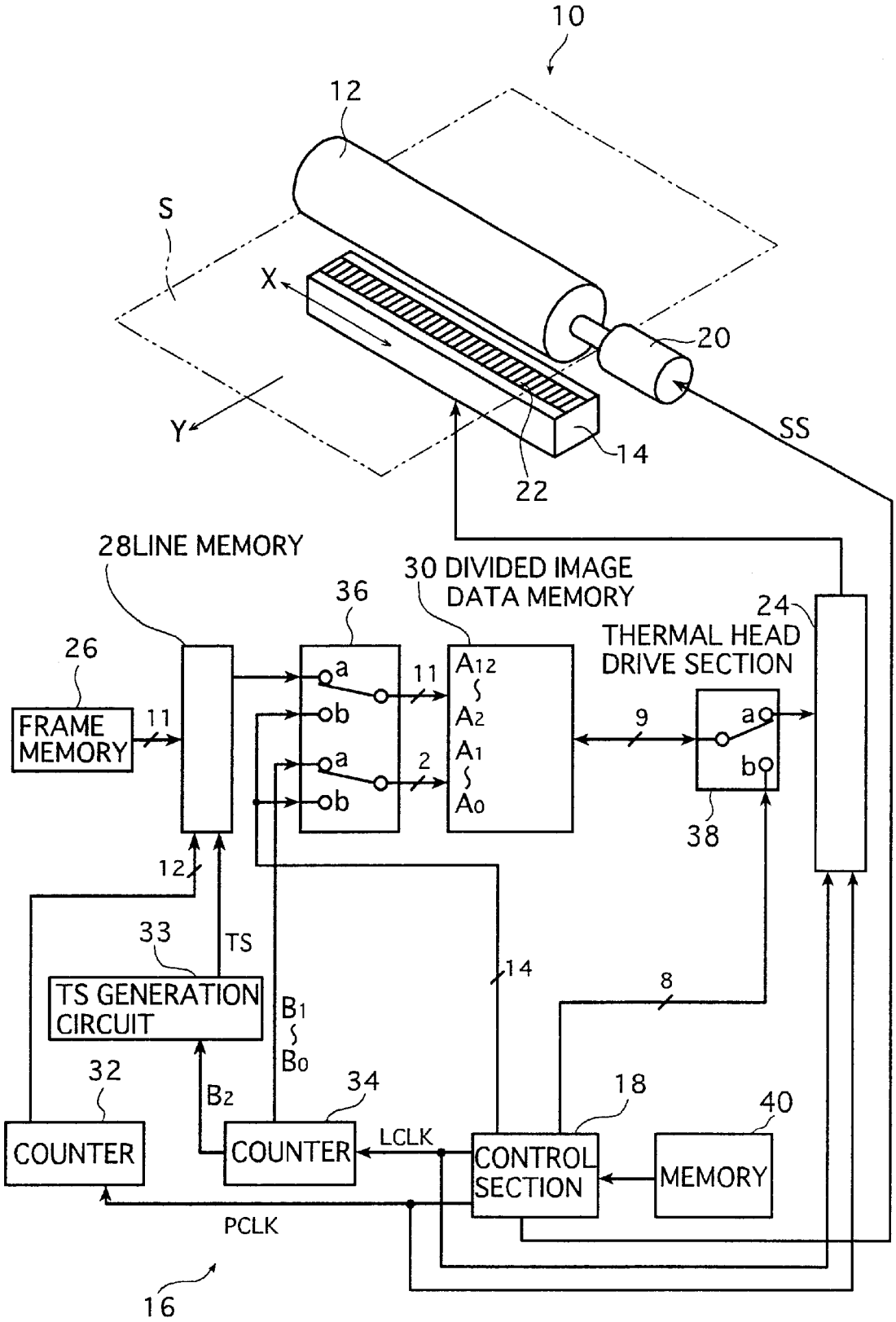
FIG. 1 is a conceptual view showing a structure of an embodiment of a thermal recording apparatus of the invention.

FIG. 1 shows a structural concept of an embodiment of a thermal recording apparatus of the invention. The thermal recording apparatus 10 shown in FIG. 1 transports a sheet of thermal recording material (hereinafter called as thermal material) S which is the recording medium in a sub-direction (in the direction of arrow Y) as it is held between a platen roller 12 and a thermal head 14 on the basis of control by an image recording control unit 16; at the same time, the apparatus 10 records toned image in the main direction (in the direction of arrow X) by means of the thermal head 14, whereby a two-dimensional continuous-tone image is eventually recorded.

The platen roller 12 is controlled by a control section 18 of the image recording control unit 16 such that it is driven to rotate by a stepping motor 20 which is a recording medium moving means in order to transport the thermal material S in the sub-direction approximately perpendicular to the main direction. On the other hand, the thermal head 14 is composed of a multiple of heating elements 22 arranged in the main direction; each heating element 22 is activated by a drive current from a thermal head drive section 24 of the image recording control unit 16 and generates heat in order to generate a color of a specified tone on the thermal material S.

Figure 2:
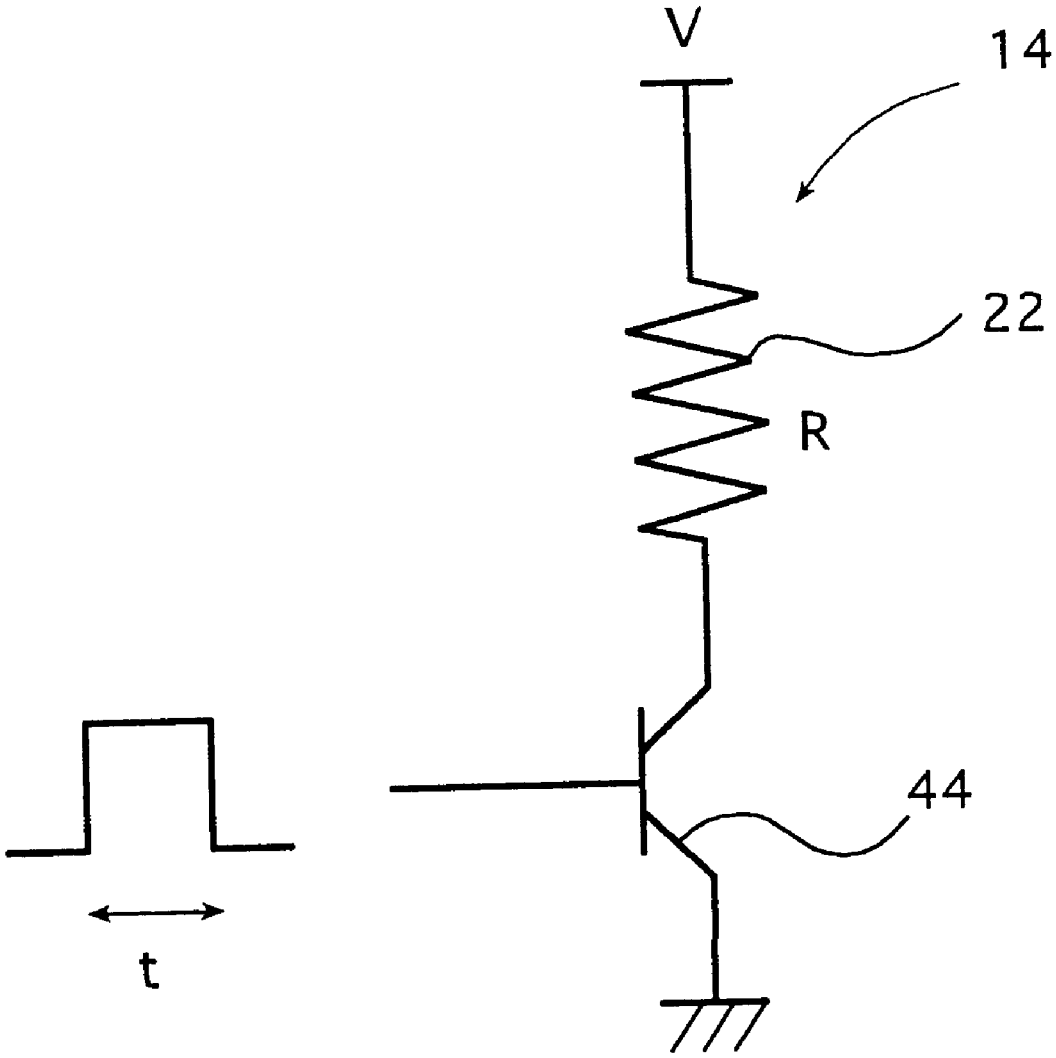
FIG. 2 is an equivalent circuit diagram showing an embodiment of a thermal head.
Figure 3A:
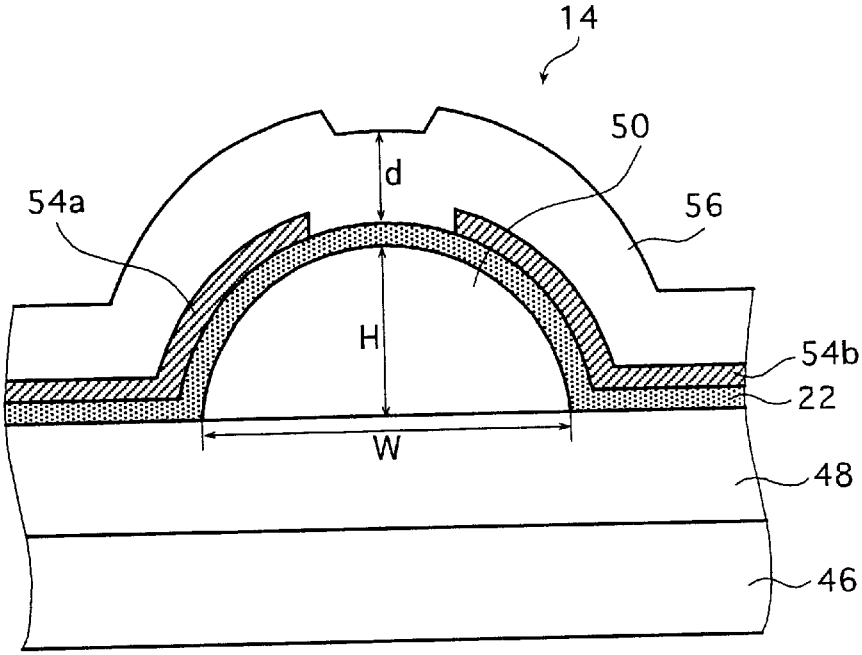
FIG. 3A is a cross-sectional view showing a structure of an embodiment of a thermal head.
Figure 3B:
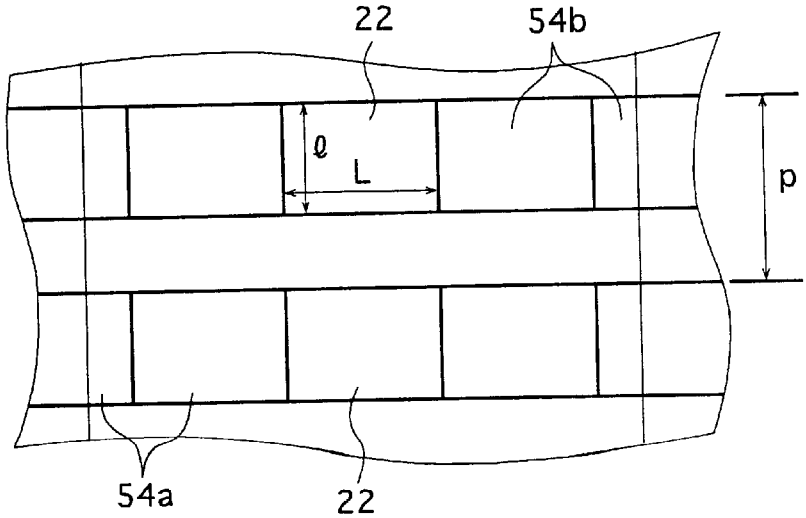
FIG. 3B is a structural view showing an upper surface of an embodiment of a thermal head.

FIG. 2 is an equivalent circuit diagram showing an embodiment of a thermal head. FIG. 3A is a cross-sectional view showing a structure of an embodiment of a thermal head. FIG 3B is a structural view showing an upper surface of an embodiment of a thermal head.

As shown in FIG. 2, the thermal head 14 is composed of heating elements 22 electrically connected between a power source and the ground by way of a switch element 44. The switch element 44 is controlled in its on-off operation by such as a pulse-width modulated control signal of image data of each pixel. The heating element is energized for a time period corresponding to a pulse width at a high level of the control signal by way of the switch element 44 so that it is controlled in a specified temperature corresponding to the image data.

In the description below, the ratio of the time period of 'on' of the switch element 44 against the time period corresponding to one cycle of the control signal is referred to as heating duty. When the heating element 22 is energized for the time period corresponding to the pulse width at the high level of the control signal, recording (heating) energy E to be supplied to the heating element 22 is shown in a formula: $E\ (V^2/R)\cdot t$, wherein V represents power source voltage of the thermal head 14; R represents resistance value of the heating element 22; and t represents the pulse width at the high level of the control signal.

As shown in FIG. 3A, the thermal head 14 is physically composed of a base 46, a ceramic substrate 48 arranged on the base 46, a glaze 50 in a semicylindrical (half circular; half elliptic) form with a height of H and a width of W arranged on the ceramic substrate 48, the heating element 22 and a pair of electrodes 54*a*, 54*b* laminated on the glaze 50 and a protective layer 56 prepared by a material having excellent wear resistance and laminated with a coating thickness (protective layer thickness) of d on all of the ceramic substrate 48, the glaze 50, the heating element 22 and a pair of electrodes 54*a*, 54*b*.

The glaze 50 is a heat storage member which holds heat generated by each heating element 22. As shown in FIG. 32, the heating element 22 is a heat generating resistor in a strip form with a width (heater width) of l and extends onto the ceramic substrate 48 on both sides in the direction of width W of the glaze 50. Take, for example, a case where a recording density of the thermal head is 300 dpi (dots/inch), a required number of the heating elements 22 to form a line are arranged with a specified pitch from each other, say, with 84.7 $\mu$m spaced apart from each other in the direction perpendicular to the direction across the paper surface shown in FIG. 3A.

A pair of the electrodes 54*a*, 54*b* serve as wiring for allowing an electric current to flow into the heating element 22 and cover the heating element 22 with the approximately same width l as that of the heating element 22. However, a gap between the electrode 54*a* and the electrode 54*b* extends along the length (heater length) L and, within this gap, the heating element 22 is not covered by the electrodes 54*a*, 54*b*. The uncovered portion (exposed portion) of the heating element 22 is located on the uppermost part of the glaze 50; hence, the heat generated by the heating element 22 is provided to the thermal material S by way of the protective layer 56 whereby a recording pixel generates color corresponding to the provided heat.

The heating element 22, a pair of the electrodes 54*a*, 54*b* and the protective layer 56 of the thermal head 14 are prepared by production techniques of a semiconductor, apparatus such as chemical vapor deposition (CVD), physical vapor deposition (PVD), sputtering, vapor deposition, photolithography and the like. Since the protective layer 56 is vapor deposited on the electrodes formed by such as etching, the uppermost portion of the protective layer 56 is recessed in accordance with the gap between the electrodes 54*a*, 54*b*. The basic construction of the thermal head 14 is such that has been outlined above.

Figure 4A:
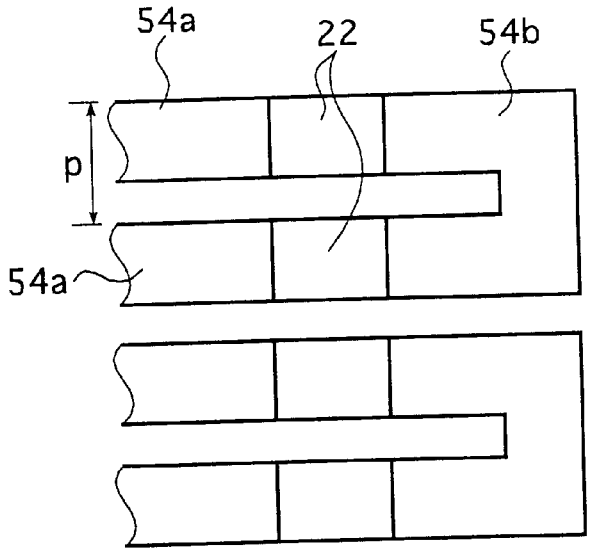
FIGS. 4A and 4B are structural views showing upper surfaces of other embodiments of a thermal head, respectively.
Figure 4B:
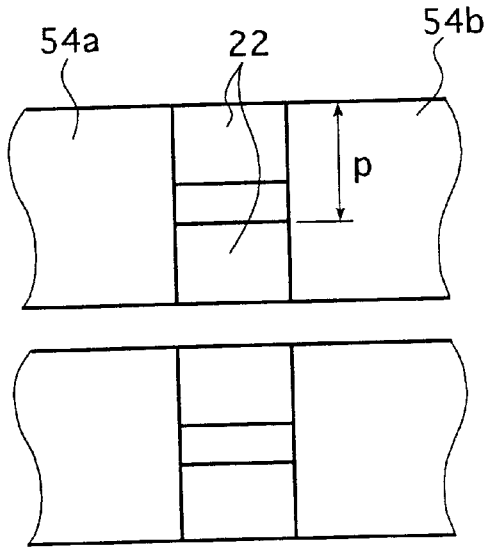

The construction of the thermal head 14 is not limited to an exemplary illustration in FIG. 3 and it may adopt any configurations such as a form like a letter 'U', as shown in FIG 4A, which has been constructed by combining electrodes 54*b* of two adjacent heating elements 22, a slit form, as shown in FIG. 4B, which has been constructed by each divided one sharing electrodes 54*a*, 54*b* of adjacent two heating elements 22 and the like. In the illustrated examples, the adjacent two heating elements 22 are controlled of their on-off operation only by the same image data.

The recording density of the thermal head 14 of the invention refers to the density of the heating elements 22 corresponding to one dot of the recording pixel to be recorded on the thermal material S, that is, the number of the heating elements 22 included in a unit length corresponding to one dot of the recording pixel. Take, for example, a case shown in FIG. 3B where the pitch of the heating element 22 is p, then the recording density of the thermal head 14 is defined as l/p. The same can be said with the thermal heads 14 in the 'U' form as shown in FIG. 4A and in the slit form as shown in FIG. 4B.

As described as the problem of the prior art, if the recording density of the thermal head 14 is, for example, about 300 dpi, the scanning line structure corresponding to coarse-graininess of dots of respective recording pixels in the thermal head 14 becomes visually recognizable, thereby deteriorating the quality of the recorded image. On the other hand, if the arranged pitch p of the heating element 22 is, for example, less than about 70 $\mu$m, the scanning line structure becomes almost invisible. Moreover, if the pitch p is 50 $\mu$m or less, then the scanning line structure becomes completely invisible.

Therefore, in order to decrease the visibility of the scanning line structure of the recording image, the thermal recording apparatus 10 of the invention performs thermal recording with the thermal head 14 having a recording density of 400 dpi or more to ensure that the arranged pitch p of the heating elements 22 becomes less than about 70 $\mu$m. However, it is preferable, as described above, that the recording density of the thermal head 14 is 500 dpi or more so as to ensure that the arranged pitch p of the heating elements 22 becomes 50 $\mu$m or less.

The image recording control apparatus 16 in a case of illustrated example comprises: a frame memory 26 for storing one page of image data, a line memory 28 for storing the two-dimensional image data stored in the frame memory 26 on a one-dimensional image data basis; a divided image data memory 30 for storing divided image data to be obtained by dividing into four portions all image data capable of being captured in one-dimensional image data, a thermal head drive section 24 for driving the thermal head 14 on the basis of the divided image data to record an image on the thermal material S, a control section 18 for controlling the above-described components, a counter 32 for counting a pixel clock signal PCLK delivered from the control section 18 to supply the line memory 28 with address data for allowing the line memory 28 to output the one-dimensional image data for each pixel and a counter 34 for counting a line clock signal LCLK delivered from the control section 18 to supply the output data B0 to B1 as low-order 2 bits of the address data for allowing the divided image data memory 30 to output the divided image data, as well as the output data B2 to a timing signal generator circuit 33 which generates a timing signal TS for allowing the one-dimensional image data to be read from the frame memory 26 into the line memory 28.

High-order 11 bits of the address data for allowing the divided image data memory 30 to output the divided image data are supplied by the one-dimensional image data delivered from the line memory 28 for each pixel.

It should also be noted that switches 36 and 38 for supplying the divided image data memory 30 with the divided image data from the control section 18 are connected such that the switch 36 is provided between the line memory 28 and the divided image data memory 30 whereas the switch 38 is provided between the divided image data memory 30 and the thermal head drive section 24. The control section 18 has a memory 40 such as ROM, RAM and the like connected thereto for storing at least all of the above-described image data divided into four portions.

One or more kinds of the image data divided into four portions may be stored in the memory 40; in the latter case, only the necessary kind or kinds of divided image data may be retrieved from the memory 40 and stored in the divided image data memory 30. Such divided image data may be adapted to be such that they are stored in the memory 40 via the control section 18 by means of an external storing medium such as FD, HD, MO or the like or, alternatively, they may be directly downloaded into the divided image data memory 30. In the case of direct storage in the divided image data memory 30, the memory 40 may be omitted.

Having outlined the basic construction of the illustrated image recording apparatus 10, we now describe its operation.

To begin with, prior to the process of image recording, the switches 36 and 38 are connected to contacts b so that the divided image data is transferred from the memory 40 via the control section 18 to be stored in the divided image data memory 30. Take, for example, a typical case where the one-dimensional image data to be supplied from the line memory 28 into the divided image data memory 30 consists of 11 bits, the output data ($B_0$–$B_1$) to be supplied from the counter 34 consists of 2 bits and the divided image data consists of 9 bits; the divided image data memory 30 is loaded with all 9-bit divided image data that correspond to all of the 13-bit address data $A_0$–$A_{12}$ of which the high-order 11 bits ($A_2$–$A_{12}$) consist of the 11-bit one-dimensional image data and the low-order 2 bits ($A_0$–$A_1$) consist of the 2-bit output data ($B_0$–$B_1$) from the counter 34.

We next describe the method of dividing multiple tone image data with reference to a typical case where the number of divided recording points (divided heating points) is 4 (the divided recording performed at 4 points), the image data is divided into 4 portions, the multiple tone image data consists of 11 bits per pixel, and the divided image data consists of 9 bits.

Table 1 below sets forth the divided image data of 2048 kinds in the range of 0–2,047 from the 11-bit multiple tone image data in the case of, as described above, the number of the divided heating (heat generation) points being four, as well as the number of the divided data point being four.

TABLE 1

| DVIDING OF MULTIPLE-TONED IMAGE DATA | | | | | | | | | | | | |
|---|---|---|---|---|---|---|---|---|---|---|---|---|
| A | 0000111 | . . . | 254 | 255 | 255 | 255 | . . . | 510 | 510 | 511 | . . . | 511 |
| B | 0001111 | . . . | 255 | 255 | 255 | 255 | . . . | 510 | 511 | 511 | . . . | 511 |
| C | 0011112 | . . . | 255 | 255 | 255 | 256 | . . . | 511 | 511 | 511 | . . . | 511 |
| D | 0111122 | . . . | 255 | 255 | 256 | 256 | . . . | 511 | 511 | 511 | . . . | 511 |
| TOTAL VALUE | 0123456 | | 1019 | 1020 | 1021 | 1022 | . . . | 2042 | 2043 | 2044 | . . . | 2047 |

As shown in table 1, in the present embodiment, a thermal recording points per pixel (i.e., lines that can be recorded per pixel with the thermal head 14 taken as a whole) are divided as four points A to D, (zeroth line A to third line D) in the direction of transport of the thermal material S.

Let us here describe the method by which a single pixel of multiple tone image data which is the one-dimensional image data being supplied from the line memory 28 is divided into approximately equal portions for calculating a plurality of the obtained approximately equal portions of divided image data.

Assume that: a given image data of one pixel is represented by $D_P$; divided number is M; and M numbers of divided image data are $d_1, d_2, \ldots, d_M$. Then, the image data $D_P$ is divided into M numbers of approximately equal portions of divided image data $d_1, d_2, \ldots, d_M$ in accordance with the following equation:

$$\begin{aligned} D_p &= d_1 + d_2 \cdots + d_M \\ &= [d_p / M] + \cdots [(d_p - d_1)/(M-1)] + \cdots + \\ &\quad [(D_p - d_1 - d_2 - \cdots - d_{M-1})] \end{aligned}$$

For example, if M assumes 4, the following relations are obtained:

The divided image data $(d_1, d_2, d_3, d_4)$=0, 0, 0, 1) for the image data $D_P$=1. In the same way, other divided image data are obtained as follows:

$(d_1, d_2, d_3, d_4)$=(0, 0, 1, 1) for $D_P$=2;

$(d_1, d_2, d_3, d_4)$=(0, 1, 1, 1) for $D_P$=3;

$(d_1, d_2, d_3, d_4)$=(1, 1, 1, 1) for $D_P$=4;

$(d_1, d_2, d_3, d_4)$=(1, 1, 1, 2) for $D_P$=5; and

In Table 1 above, it should be noted here that if the image data $D_P$ assumes the value 2044, all divided image data in zeroth line A to third line D assume 511; hence, if $D_P$ assumes 2044 to 2047, the divided image data all assume the same value of 511.

All the divided image date thus set forth in Table 1 are preliminarily prepared and stored in the memory 40 or any suitable external storing device and the like. All of the divided image data stored in the memory 40 or an external storing device is read by means of the control section 18 and stored in the divided image data memory 30 as described above; in this case, the individual pieces of divided image data shown in Table 1 are tagged with 13-bit address data 0 to 8191 as shown in Table 2 below.

As is clear from Table 2, data placement in the divided image data memory 30 is such that a pixel of image data is divided into 4 portions to be assigned to the zeroth line A to the third line D and the thus assigned data are stored in the following order: 0, 0, 0, 0 (image data $D_P$=0)/0, 0, 0, 1 (image data $D_P$=1)/. . . /255, 255, 255, 256 (image data $D_P$=1021)/. . . /511, 511, 511, 511 (image data $D_P$=2047). In this case, $A_1$, $A_0$ which are the low-order 2 bits of the above-mentioned 13-bit address data $A_0$ to $A_1$, designate the divided image data for the zeroth line A ($A_1$=$A_0$=0), the first line B ($A_1$=0, $A_0$=1), the second line C ($A_1$=1, $A_0$=0) and the third line D ($A_1$=$A_0$=1) which are to be recorded on the thermal material S by means of the thermal head 14. On the other hand, $A_2$–$A_{12}$ which are the high-order 11 bits of the address data $A_0$–$A_{12}$ designate that the image data of interest represents the yet to be divided 11-bit image data of one pixel.

Figure 5:
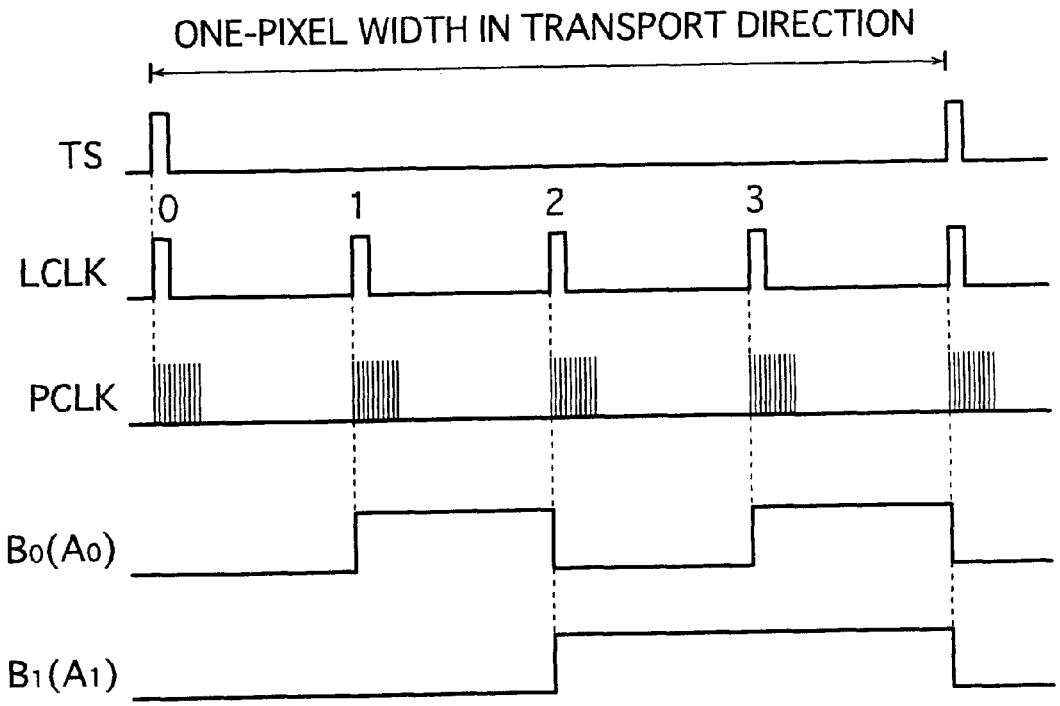
FIG. 5 is a timing chart for an embodiment of operation of a thermal recording apparatus of the invention.

Upon storing the divided image data in the divided image data memory 30 in the manner described above, the apparatus 10 starts the following image recording process in accordance with the timing chart shown in FIG. 5, with the switches 36 and 38 kept connected to contacts a in FIG. 1.

First, the control section 18 outputs specified drive signals SS to the stepping motor 20 which, in response to the applied drive signals SS, drives the platen roller 12 to rotate so that the thermal material S is transported at a specified speed in the direction of arrow Y. At the same time, the control section 18 generates pixel clock signals PCLK and line clock signals LCLK, the former being delivered to the counter 32 and the latter to the counter 34.

The counter 34 then outputs output data $B_2$ to the timing signal generator circuit 33 which, in response to the applied output data $B_2$, outputs timing signals TS either in synchronism with or proportional to the drive signals SS. When the timing signals TS are supplied into the line memory 28, the two-dimensional image data stored in the frame memory 26 are read for each piece of the one-dimensional image data being recorded on the thermal material S in the direction of arrow X and are subsequently transferred for storage in the line memory 28.

When pixel clock signals PCLK are inputted from the control section 18 to the counter 32, the latter performs a sequential countup in synchronism with the pixel clock signals PCLK to produce output data and to supply it as address data to the line memory 28. In accordance with the supplied address data, the line memory 28 outputs the one-dimensional image data per pixel and supplies them as address data to the high-order 11 bits ($A_2$–$A_{12}$) in the divided image data memory 30 via the switch 36.

TABLE 2

DEVIDED IMAGE DATA STORED IN DEVIDED IMAGE DATA MEMORY

| IMAGE DATA | 0 | | 1 | | 1021 | | 2044 | | 2047 | |
|---|---|---|---|---|---|---|---|---|---|---|
| | AD-DRESS | DEVIDED IMAGE DATA | AD-DRESS | DEVIDED IMAGE DATA | AD-DRESS | DEVIDED IMAGE DATA | AD-DRESS | DEVIDED IMAGE DATA | AD-DRESS | DEVIDED IMAGE DATA |
| 0TH LINE A | 0 | 0 | 4 | 0 | 4084 | 255 | 8176 | 511 | 8188 | 511 |
| 1ST LINE B | 1 | 0 | 5 | 0 | 4085 | 255 | 8177 | 511 | 8189 | 511 |
| 2ND LINE C | 2 | 0 | 6 | 0 | 4086 | 255 | 8178 | 511 | 8190 | 511 |
| 3RD LINE D | 3 | 0 | 7 | 1 | 4087 | 256 | 8179 | 511 | 8191 | 511 |

On the other hand, when the line clock signals LCLK are inputted from the control section 18 to the counter 34, the latter performs a sequential countup in synchronism with the LCLK and supplies $B_0$ to $B_1$ which are the data with first two bits from the lowest-order bit side of the output data as address data to the low-order 2 bits ($A_0$ to $A_1$) in the divided image data memory 30 via the switch 36 while, at the same time, as described above, the output data $B_2$ of the highest-order bit is supplied to the timing signal generator circuit 33 as a signal for generating timing signals TS.

In the above-described case, the divided image data memory 30 is supplied with the 13-bit address data of which the high-order 11 bits consist of the yet to be divided one-dimensional image data, with the low-order 2 bits representing the zeroth line A to the third line D on the thermal material S.

TABLE 3

| | IMAGE DATA | 1 | 3 | 401 | 1022 | 2044 | 7 | 0 | . . . |
|---|---|---|---|---|---|---|---|---|---|
| DIVID- | 0TH LINE A | 0 | 0 | 100 | 255 | 511 | 1 | 0 | |
| ED | 1ST LINE B | 0 | 1 | 100 | 255 | 511 | 2 | 0 | |
| IMAGE | 2ND LINE C | 0 | 1 | 100 | 256 | 511 | 2 | 0 | |
| DATA | 3RD LINE D | 1 | 1 | 101 | 256 | 511 | 2 | 0 | . . . |

Assume here that Table 3 shows an example of the tone image data which are to be recorded on the basis of Table 2. If the zeroth line A of the image data representing 1, 3, 401, 1022, 2044, 7, 0, . . . as shown in Table 3 is to be recorded, $B_0$ and $B_1$ which are the data being delivered from the counter 34 are all reset to zero by the zeroth line clock signal LCLK and also the divided image data of which the low-order 2-bit address data are stored at the addresses of $A_0=A_1=0$ are selectively outputted from the divided image data memory 30 on a pixel basis to be supplied into the thermal head drive section 24 by way of the switch 38.

The thermal head drive section 24 receives the divided image data of all pixels in the lineal direction for the zeroth line which are selectively outputted from the divided image data memory 30 on a pixel basis and then performs pulse-width modulation on the received divided image data for allowing specified drive currents to flow into respective individual heating elements 22 in the thermal head 14 for the time duration of the respective modulated pixels. Such drive currents that are allowed to flow for the time periods corresponding to the divided image data of the respective pixels cause an image for one record line to be recorded on the thermal material S.

Stated more specifically, driving the thermal head 14 in accordance with those one-dimensional divided image data, the thermal head drive section 24 first causes the image for the zeroth line A to be recorded on the thermal material S. Similarly, the address data at the low-order 2 bits $A_0$ and $A_1$ in the divided image data memory 30 are sequentially updated in response to the line clock signals LCLK so that the images for the first line B to the third line D are recorded. As a result, the thermal material S has an image recorded thereon as the image is divided among four record lines within the width of one pixel in the transport direction, with the resulting image being not biased to either the record start or end side of one pixel and being of high quality that are neither scratchy nor deteriorated in quality.

In the illustrated embodiment, the respective divided image portions are recorded by pulse-width modulation but this is not the sole case of the invention and they may be recorded by pulse-number modulation or by the combination of the two modulation techniques. It is also within the scope of the invention to supply every two adjacent heating elements 22 in the thermal head 14 with drive currents at times that are offset by a specified amount to ensure that the image of higher quality which is further reduced in density unevenness can be obtained.

Though an appropriate value of the number of the divided heating points is described later, the number of the divided heating points, the number of divided data points, as disclosed in Unexamined Published Japanese Patent Application (kokai) No. 10-44509 by the present applicant, may be divided in any other ways or in any other combinations as long as the number of the divided data points are smaller than the number of the divided heating points. In the illustrated embodiment, the bit number representing the number of tones in the multiple tone image data per pixel is represented by 11 bits and that in the divided image data is represented by 9 bits. Again, the invention is by no means limited to these bit numbers and any other values may be assumed.

We next describe relationship between respective recording conditions which give influence to sharpness of images to be recorded and sharpness of recorded images by reference to graphs shown in FIGS. 6A to 10B. In these cases, the horizontal axis and the vertical axis of each graph represent spacial frequency (c/mm) and sharpness (%) of the recorded image, respectively. The graphs of FIGS. 6A, 7A, 8A and 9A show sharpness in the main direction (heating element 22 arrangement direction) of the recorded image while the graphs of FIGS. 6B, 7B, 8B and 9B show sharpness in the sub-direction (thermal material S transport direction).

Each of the graphs has not been subjected to sharpness correction and shows characteristics of each recorded image of which only specified recording conditions within the following recording conditions have been changed:

Recording density of the thermal head 14: 300 dpi

Heater width 1×heater length L of the heating element: 69×110 μm

Protective layer thickness of the glaze 50: 11–12 μm

Divided heating points per pixel: 8

Heating duty of the control signals at the maximum density recording time: 70–80%

Figure 6A:
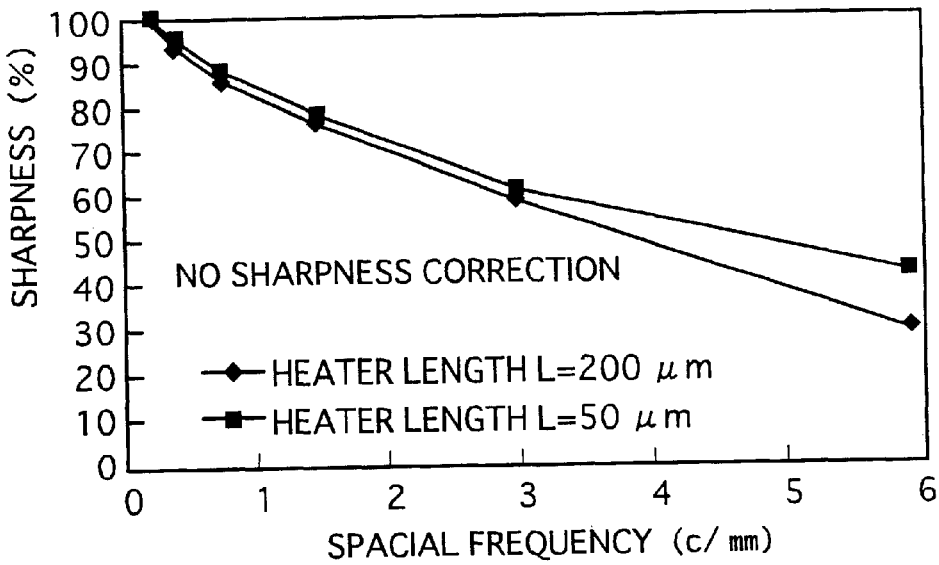
FIGS. 6A and 6B are graphs showing an embodiment of relationship between sharpness and heater length in a main direction and a sub-direction, respectively.
Figure 6B:
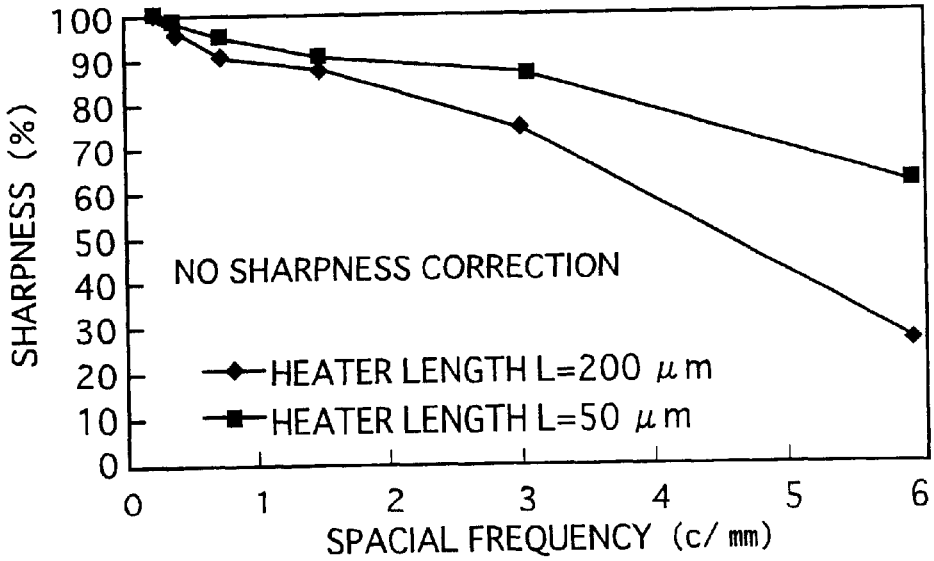

To begin with, each of FIGS. 6A and 6B shows a graph of an embodiment representing a relationship between sharpness and a heater length. Each graph, as shown in FIG. 6B for example, shows sharpness of the recorded image in two cases where image recordings have been performed using respective thermal heads 14 comprising heating elements 22 with respective heater length L of 200 μm and 50 μm. As shown in these graphs, sharpness of each recorded image increases both in the main and sub-directions as the heater length L becomes shorter.

Namely, if the heater length L becomes shorter, it is a matter of course that the physical recording resolution in the sub-direction increases and, moreover, since the contact time of the thermal head 14 with the thermal material S becomes shorter, image recording is essentially performed at high temperature for a short period of time to decrease blur due to diffusion of heat distribution. The length of the heating element 22 capable of being established independently of both the arrangement pitch p and the heater width l is preferably set between 30 μm and 60 μm.

Figure 7A:
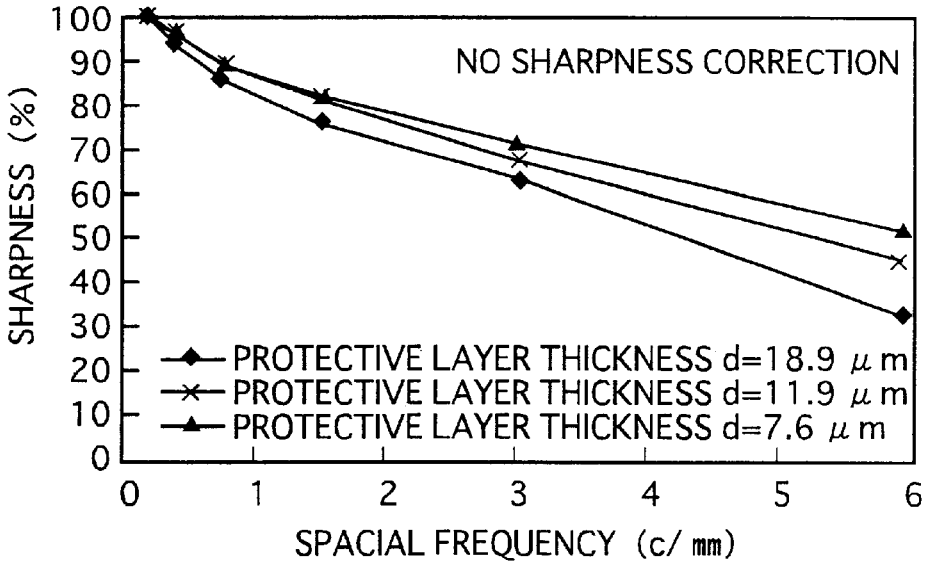
FIGS. 7A and 7B are graphs showing an embodiment of relationship between sharpness and protective layer thickness in the main direction and the sub-direction, respectively.
Figure 7B:
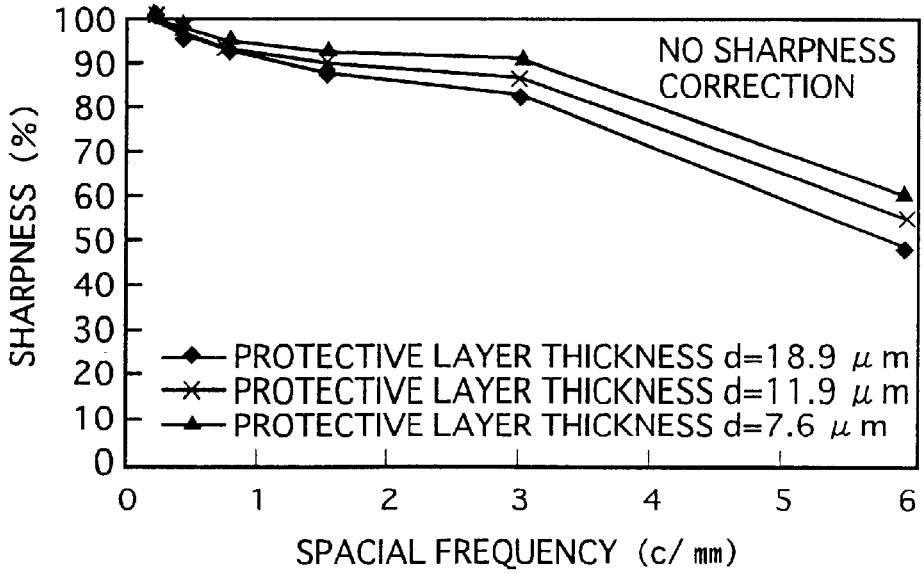

Next, each of FIGS. 7A and 7B shows a graph of an embodiment representing a relationship between sharpness and protective layer thickness. Each of these graphs, as shown in FIG. 7B for example, shows sharpness of the recorded image in three cases where image recordings have been performed using the respective thermal heads 14 comprising the protective layers 56 with respective thicknesses of 18.9 μm, 11.9 μm and 1.6 μm. As shown in these graphs, sharpness of the recorded image increases both in the main and sub-directions as the protective layer thickness d of the glaze 50 becomes thinner.

The temperature distribution is spacially diffused by heat propagation; however, the shorter the distance between the heating elements 22 and the surface of the thermal head 14 becomes, namely, the thinner the thickness d of the protective layer becomes, the smaller the blur of the recorded image due to diffusion of the heat distribution. The thickness d of the protective layer 56 of the glaze 50 is generally determined by taking into consideration durability and the like of the thermal head 14 and, depending on a kind of a material to be employed, is preferably 4–8 μm in a case where nitrogen containing glass or the like such as silicon carbide (SiC), silicon nitride (SiN), tantalum oxide ($Ta_2O_5$), SIALON (Si—Al—O—N), LASION (La—Si—O—N) or the like is employed.

Figure 8A:
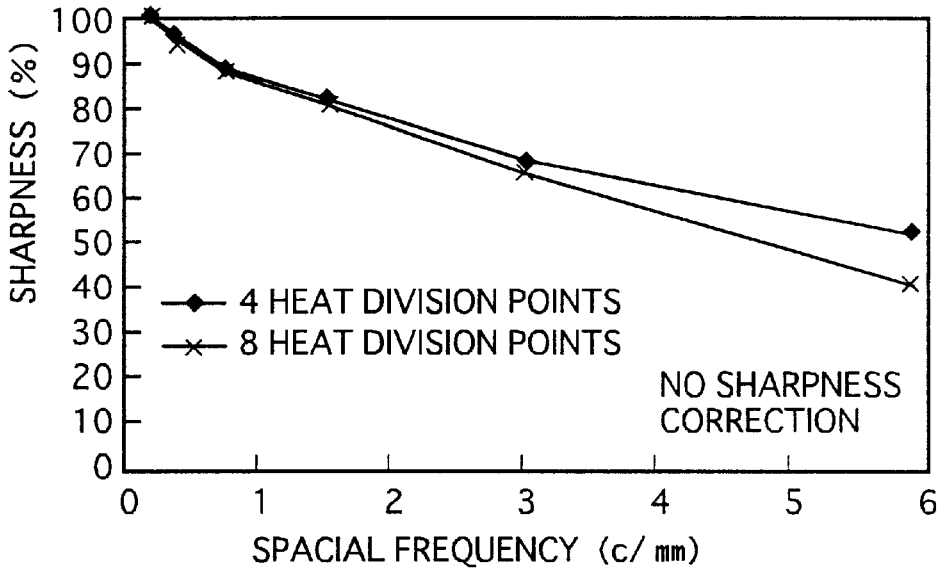
FIGS. 8 and 8B are graphs showing an embodiment of relationship between sharpness and heat division number in the main direction and the sub-direction, respectively.
Figure 8B:
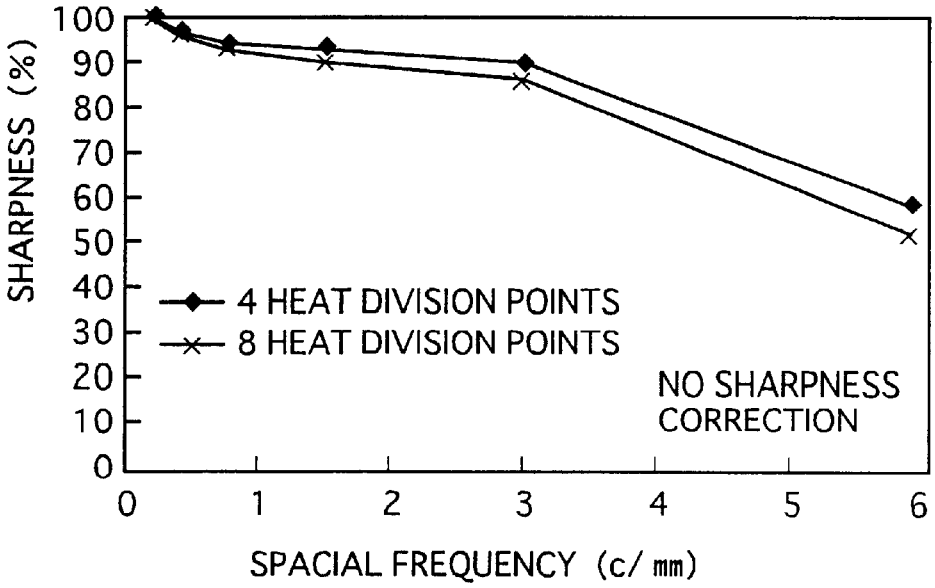

Next, each of FIGS. 8A and 8B shows a graph of an embodiment representing a relationship between sharpness and numbers of divided heating points Each of these graphs shows sharpness of the recorded image in two cases where image recordings have been performed with the number of the divided heating points per pixel of the image to be recorded being set to 4 and 8, respectively. As shown in these graphs, the sharpness of the recorded image increases both in the main and sub-directions as the number of the divided heating points decreases.

Figure 11:
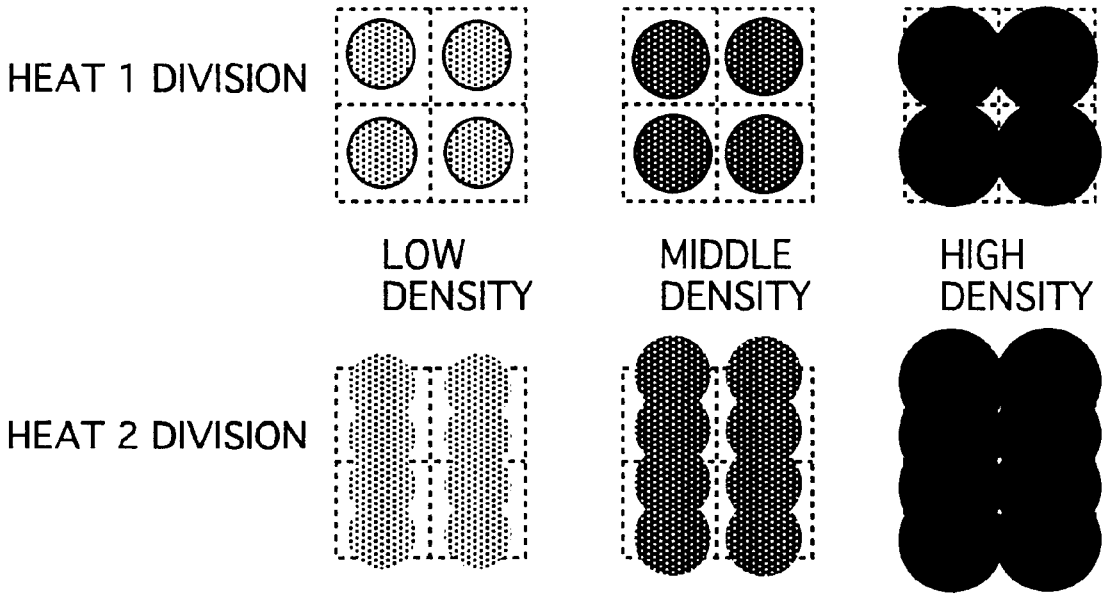
FIG. 11 is a conceptual diagram showing an embodiment of heat division recording.

The heat generated when the heating element 22 is heated (time duration of the switch element 44 being 'on') diffuses by a specified delay in time of response after it has been heated (time duration of the switch element 44 being 'off'); however, the more the number of divided heating points, the shorter the time period till the next start, thereby likely bringing about an influence of diffused heat. As shown in FIG. 11, when the number of the divided heating points is one, a pixel assumes a dot form, that is, a dotted image (halftone image); the lower the dot density, the smaller it becomes.

Therefore, a space between pixels becomes large in low and middle densities; when a transmission original for medical application is observed, graininess caused by a transmitted light from the space is unfavorably perceived or graininess becomes conspicuous in an unfavorable way. On the other hand, when the number of the divided heating points is 2 or more, dots are overlapped in parts with each other in the sub-direction to form a continuous line for allowing the pixels to become a scanning line with no space between them in the sub-direction whereby unevenness to be caused by fluctuation of a sub-scanning speed is substantially prevented. Accordingly, the number of the divided heating points is preferably set as 2 to 4.

Figure 9A:
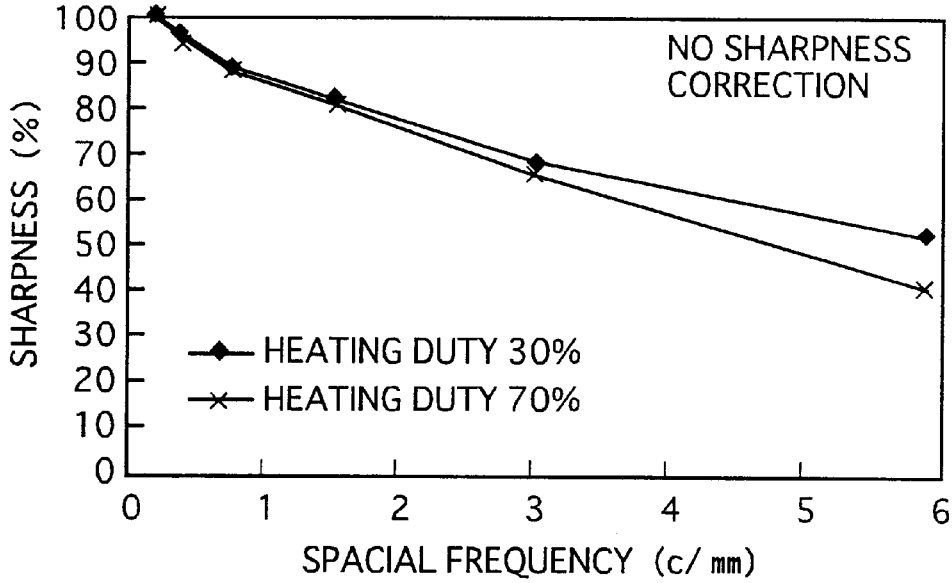
FIGS. 9A and 9B are graphs showing an embodiment of relationship between sharpness and heating duty in the main direction and the sub-direction, respectively.
Figure 9B:
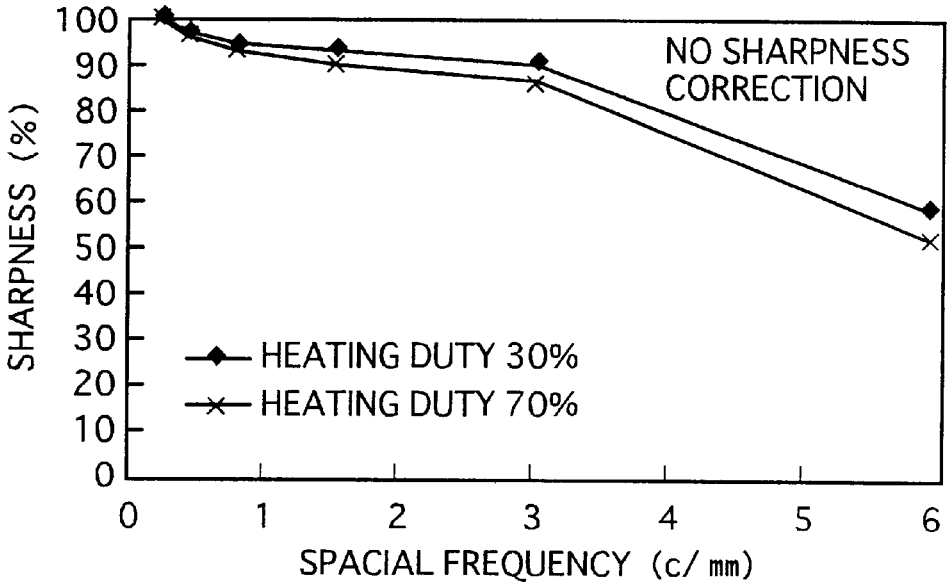

Next, each of FIGS. 9A and 9B shows a graph of an embodiment representing a relationship between sharpness and heating duty. Each of these graphs shows sharpness of the recorded image in two cases where image recordings have been performed with the respective heating duties of the control signal at the maximum density recording time periods being set as respective 30% and 70%. As shown in these graphs, the sharpness of the recorded image increases both in the main and sub-directions as the heating duty of the control signal at the maximum density recording time decreases.

If the heating duty of the control signal becomes smaller, a heating period of the heating element becomes shorter; in order to obtain the same recording energy E in the shorter period of heating time as that at the time when the heating duty of the control signal is larger, it is necessary to increase the power voltage V of the thermal head 14, Accordingly, the smaller the heating duty, the shorter the recording time and the higher the recording temperature; hence, an influence of blur due to heat diffusion decreases and, thus, it is preferable that the heating duty of the control signal is between 25% to 50%.

Figure 10A:
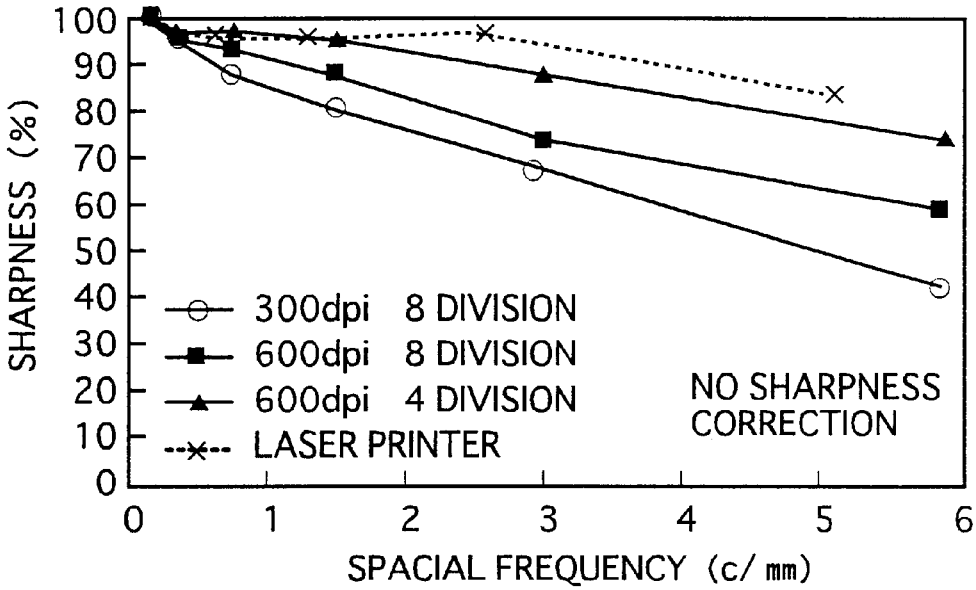
FIGS. 10A and 10B are graphs showing an embodiment of relationship between sharpness and recording density in the main direction and the sub-direction, respectively.
Figure 10B:
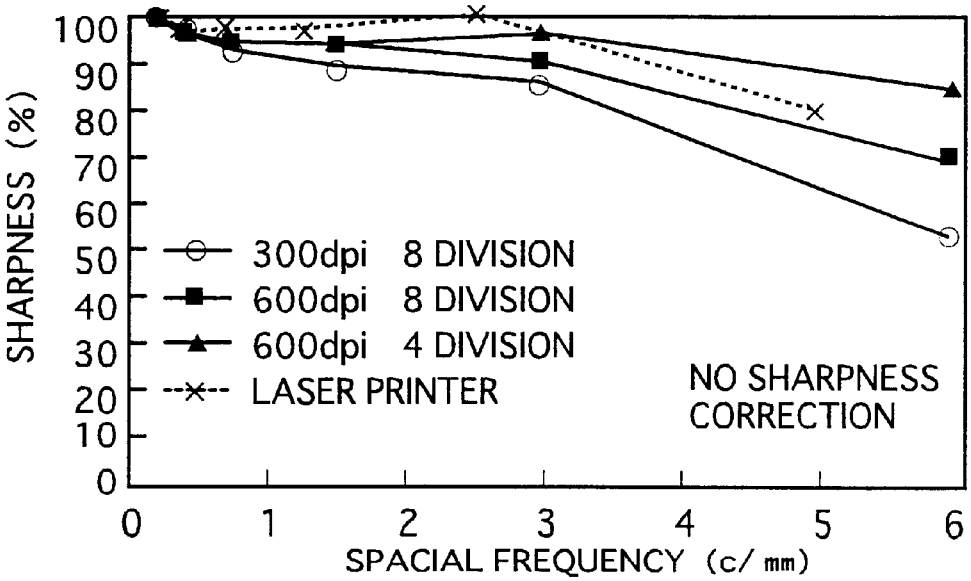

Next, each of FIGS. 10A and 10B shows a graph of an embodiment representing a relationship between sharpness and recording density. Each of these graphs shows sharpness of the recorded image in a case where image recording has been performed using the thermal head 14 with a recording density of 300 dpi (heater width: 69 μm, heater length l: 110 μm and protective layer thickness: 11.9 μm ), the number of divided heating points being 8 and the heating duty being 70% and in other cases where image recordings have been performed using the thermal heads 14 with a recording density of 600 dpi (heater width: 32 μm, heater length: 40 μm and protective layer thickness: 5 μm), the numbers of divided heating points being respective 8 and 4 and the heating duty being 40%. In each of these graphs, sharpness of the recorded image in a case where image recording has been performed by a laser beam is also shown.

As shown in these graphs, the sharpness of the recorded image increases both in the main and sub-directions as the recording density of the thermal head 11 increases. As already described, the sharpness of the recorded image increases as the number of the divided heating points per pixel decreases. Take, for example, a case where the recording density of the thermal head 14 is increased and, at the same time, the number of divided heating points are decreased and, then, by properly combining some or all of the above described conditions, sharpness approximately equal to that of the laser printer can be obtained without performing any sharpness correction.

Though not shown in figures, the sharpness of the recorded image is increased as the heater width l of the heating element 22 is brought to be smaller. However, the scanning line structure of the recorded image becomes more visible as the heater width l of the heating element 22 is brought to be smaller so that it is preferable that the heater width l of the heating element 22 is determined in accordance with the recording density of the thermal head 14. The heater width l of the heating element 22 is smaller in value than the arrangement pitch p; in the case of the thermal recording apparatus 10 of the invention, the heater width l is preferably between 20 μm to 50 μm.

Therefore, in the thermal recording apparatus 10 of the invention, the image is basically recorded by the following steps: using the thermal head 14 with a recording density of 400 dpi or more; setting the power voltage of the thermal head 14 in a way that allows the heating duty of the control signal at the maximum density recording time of the image to be between 25% to 50%; and setting the number of divided heating points per pixel in the sub-direction to be 2 to 4. Moreover, as described above, it is preferable that some or all of the heater width l, the heater length L of the thermal head 14 and the protective layer thickness d are appropriately combined.

Having been described above, in the thermal recording apparatus of the present, the scanning line structure is capable of being visually unrecognizable by increasing the recording density of the thermal head; the sharpness of the recorded image can be enhanced by properly combining some or all of the heating duty, the number of the divided heating points, the heater width, the heater length and the protective layer thickness; since sharpness correction is not necessary, noise components are not emphasized and the artifact is not generated, either; hence, the recorded image of high-quality can be obtained.

In a case that the recording density of the thermal head is increased in order to produce a high-quality image as has been described, if the image recording is performed using the same image data, the size of the recorded image becomes smaller. Take, for example, a case where the thermal recording apparatus employing the thermal head with a recording density of 254 dpi (the pitch p of the heating elements being 100 $\mu$m) is changed to the thermal recording apparatus employing the thermal head with a recording density of 300 dpi (the pitch p of the heating elements being 84.7 $\mu$m) while the same image data which is to be recorded on the condition that 100 $\mu$m is recorded as one pixel is applied to both of the above apparatuses, the size of the recorded image in the main direction by the latter apparatus is reduced to 84.7/100. The change of the apparatuses is not the sole case of the reduction of the recorded image in size and another change, for example, from the recording apparatus employing laser exposure with a recording density of 254 dpi to the thermal recording apparatus employing the thermal head with a recording density of 300 dpi may act similarly.

Figure 12:
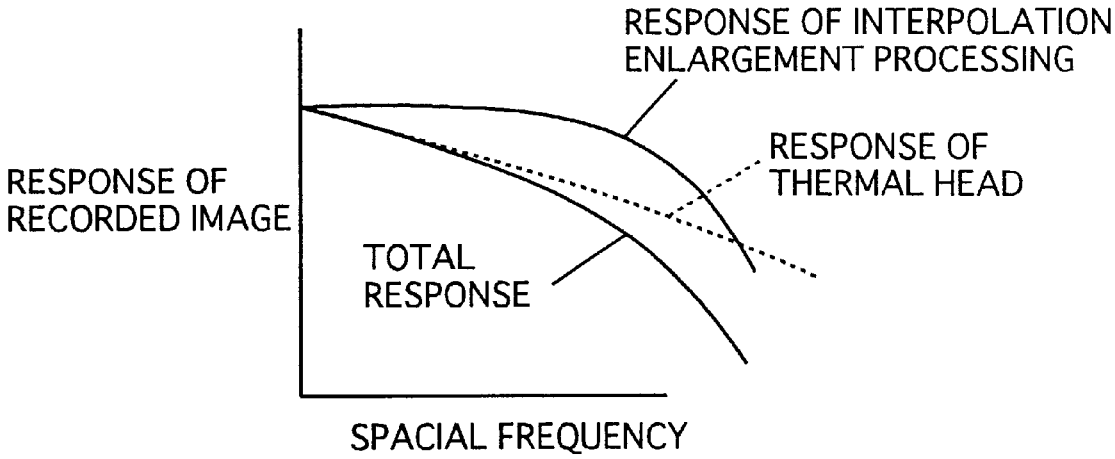
FIG. 12 is a graph showing an embodiment of response of interpolation enlargement processing.

Therefore, the image data has usually been subjected to enlargement processing so as to obtain the same size of the recorded image even after the apparatus was changed. However, such enlargement processing has added a response of interpolation enlargement processing to a processing response tagged to the thermal head, as shown in FIG. 12, whereby the total response (i.e., sharpness) has substantially decreased; hence, it was necessary for sharpness correction processing to have been so much emphasized as to compensate this decrease, thereby having brought about the noise problem or the artifact problem as described above.

Figure 13:
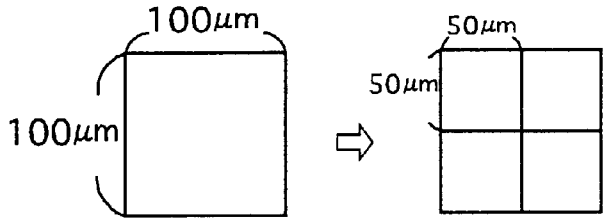
FIG. 13 is a conceptual diagram showing an embodiment of a recorded image.
Figure 14:
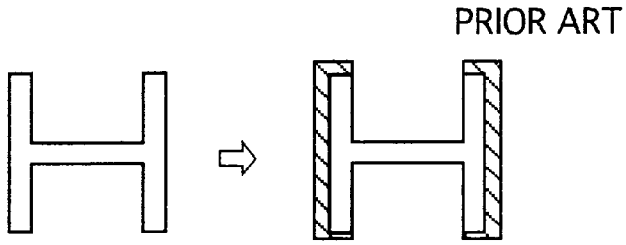
FIG. 14 is a conceptual diagram showing an example of an artifact

Therefore, in the thermal recording apparatus of the invention, it is preferable that the recording density of the thermal head of the changed-over apparatus takes a product of the recording density of the thermal head of the prior apparatus multiplied by an integer, in order to prevent such decrease of the response due to the interpolation enlargement processing Take, for example, the case, as described above, where the thermal recording apparatus employing the thermal head with a recording density of 254 dpi (the pitch p of the heating elements being 100 $\mu$m) is changed to the thermal recording apparatus employing the thermal head with a recording density of 508 dpi (the pitch p of the heating elements being 50 $\mu$m) for recording the image data on the condition that 100 $\mu$m is recorded as one pixel, then in the changed-over apparatus, as shown in FIG. 13, the same image data is recorded twice repeatedly in both the main and sub-directions thereby allowing one pixel of 100 $\mu$m at the time of before the changeover of the apparatuses to be recorded as four pixels of 50 $\mu$m at the time of after the changeover of the apparatuses.

Thus, the multiplication of the recording density of the thermal head at the time of before the change-over of the apparatuses by an integer enables to subject a replication to the interpolation enlargement processing without decreasing the response by such interpolation enlargement processing; hence, the decrease of sharpness can be prevented.

While the thermal recording apparatus of the invention has been described in detail, the invention is by no means limited to the foregoing embodiments and it should be noted that various modifications and design alternations may of course be made without departing from the spirit and scope of the invention.

As has been described in detail, the thermal recording apparatus of the invention is to record the image by dividing the heat recording points per pixel in the sub-direction into between 2 and 4 using the thermal head in which the recording density is 400 dpi or more. Accordingly, in the thermal recording apparatus of the invention, the scanning line structure can be made visually unrecognizable; hence, the recorded image with the sharpness similar to that the laser printer produces can be obtained. Therefore, according to the thermal recording apparatus of the invention, the sharpness correction processing is unnecessary so that the recorded image of high quality in which the noise components are not emphasized and the artifact is not generated either can be obtained.

What is claimed is:

1. A thermal recording apparatus for two-dimensionally recording an image on a thermal recording material, said apparatus comprising:

a thermal head comprising a plurality of heating elements arranged in a main direction, wherein said thermal head has a recording density of 400 dpi or more; and a transport means operable to impart relative movement between the thermal recording material and the thermal head in a sub-direction perpendicular to said main direction of the heating elements;

wherein said thermal head records images by dividing heat recording into a plurality of heating points of a pixel using between 2 heating points and heating points per pixel in said sub-direction, wherein an on time of a control signal, which controls an ON-OFF cycle of said plurality of heating elements, is between 25% and 50% of a total time for the ON-OFF cycle of the control signal, said on time being based on a maximum density recording by the thermal head.

2. The thermal recording apparatus according to claim 1, wherein a heater width of each of said plurality of heating elements in the main direction is between 20 $\mu$m and 50 $\mu$m and wherein a heater length of each of said plurality of heating elements in the sub-direction is between 30 $\mu$m and 60 $\mu$m.

3. A thermal recording apparatus according to claim 1, wherein each of said plurality of heating elements includes a protective layer, and a thickness of the protective layer is between 4 $\mu$m and 8 $\mu$m.

4. A thermal recording apparatus for two-dimensionally recording an image on a thermal recording material, said apparatus comprising:

a thermal head-comprising a plurality of eating elements arranged in a main direction, wherein said thermal head has a recording density of 400 dpi or more; and a transport means operable to impart relative movement between the thermal recording material and the thermal head in a sub-direction perpendicular to said main direction of the heating elements;

wherein said thermal head records images by dividing heat recording into a plurality of heating points of a pixel using between 2 heating points and 4 heating points per pixel in said sub-direction, wherein the recording density of said thermal head is 508 dpi.

5. The thermal recording head according to claim 4, wherein the recording density of 508 dpi is provided under a condition of 100 micrometers.

6. A thermal recording apparatus comprising:

a plurality of heating elements arranged in a first direction;

a conveyor operable to provide relative movement between the plurality of heating elements and a recording medium, said relative movement being in a second direction which is substantially perpendicular to said first direction;

a controller for controlling the plurality of heating elements to form an image from image data corresponding to a pixel by forming a plurality of dots for each pixel in the second direction, wherein an on time of a control signal of the controller, which controls an ON-OFF cycle of said plurality of heating elements, is between 25% and 50% of the ON-OFF cycle, said on time being based on a maximum density recording by the plurality of heating elements.

7. The thermal recording apparatus according to claim 6, wherein the controller controls the plurality of heating elements to form between 2 and 4 dots for each pixel in the second direction.

8. The thermal recording apparatus according to claim 7, wherein the each of said plurality of heating elements has a width in the first direction between 20 $\mu$m and 50 $\mu$m and a length in the second direction between 30 $\mu$m and 60 $\mu$m.

9. The thermal recording apparatus according to claim 8, wherein the plurality of heating elements provides a recording density of 400 dots per inch or more.

10. The thermal recording apparatus according to claim 9, wherein the dots for each pixel overlap in the second direction.

11. The thermal recording apparatus according to claim 10, wherein each of said plurality of heating elements includes a protective layer, and said protective layer has a thickness between 4 $\mu$m and 8 $\mu$m.

12. The thermal recording apparatus according to claim 10, wherein the plurality of heating elements provides a recording density of 508 dots per inch.

* * * * *